United States Patent [19]

DuNah

[11] Patent Number: 4,952,838

[45] Date of Patent: Aug. 28, 1990

[54] SURFACE MOUNT MINIATURE INCANDESCENT LAMP ASSEMBLY

[75] Inventor: Richard E. DuNah, Sonoma County, Calif.

[73] Assignee: Precision Lamp, Inc., Cotati, Calif.

[21] Appl. No.: 295,811

[22] Filed: Jan. 11, 1989

[51] Int. Cl.[5] ..... H01K 1/24

[52] U.S. Cl. ..... 313/318; 313/315; 313/331

[58] Field of Search ..... 313/315, 318, 623, 624, 313/578, 331, 332; 439/612

[56] References Cited

U.S. PATENT DOCUMENTS

| | | | |
|---|---|---|---|
| 2,864,025 | 12/1958 | Foote et al. | 313/315 X |
| 3,855,495 | 12/1974 | Pappas et al. | 313/318 |
| 4,069,437 | 1/1978 | Notelteirs et al. | 313/315 |
| 4,130,774 | 12/1978 | Cosco et al. | 313/318 |

*Primary Examiner*—Kenneth Wieder

*Attorney, Agent, or Firm*—Flehr, Hohbach, Test, Albritton & Herbert

[57] ABSTRACT

A resiliently mounted miniature incandescent lamp assembly.

3 Claims, 1 Drawing Sheet

SURFACE MOUNT MINIATURE INCANDESCENT LAMP ASSEMBLY

BRIEF DESCRIPTION OF THE INVENTION

This invention relates generally to a surface mount miniature incandescent lamp assembly, and more particularly to a surface mount miniature incandescent lamp assembly in which the lamp is resiliently mounted in end caps.

BACKGROUND OF THE INVENTION

Prior art surface mount lamps have included a filament axially mounted in an elongated cylindrical envelope with leads extending from the ends of the envelope. FIGS. 1 and 2 show a prior art lamp assembly 11 which includes a filament 12 enclosed in a cylindrical envelope 13 with beads 14 receiving and supporting the filament leads 16 and 17, and completing the evacuated envelope. The leads can be directly secured to an associated circuit to mount the lamp to the surface. The leads are fragile and must be manipulated to make contact with the associated circuit.

In order to provide a surface mount that spaces the lamp from the mounting surface and to facilitate mounting of the lamp by automatic equipment there have been provided cupshaped end caps 18 which receive the end of the envelope and to which the leads are affixed. An insulating material is injected in the end caps and supports the lamp in the end caps. The insulating material used has generally been rigid, hard material whereby any mechanical shock to the board on which the lamp is mounted or the end cap is transmitted to the lamp and its fragile filament or the material has been a resilient material which does not adhere to the metal end cap and glass and therefore, does not form a good bond between the glass, metal end cap and lead. Problems have also been encountered in filling the space between the glass envelope and the end cap to securely mount the lamp because low viscosity curable compounds have been used, or if high viscosity compounds are used, they fail to fill the space between the glass and end cap.

OBJECTS AND SUMMARY OF THE INVENTION

It is an object of this invention to provide an improved surface mount miniature incandescent lamp assembly.

It is another object of this invention to provide a miniature incandescent lamp assembly in which the ends of the lamp are resiliently supported in cylindrical end caps.

It is a further object of this invention to provide a surface mount miniature incandescent lamp assembly in which resilient, pliable material supports the lamp in space relationship to the walls of end caps to absorb mechanical shock.

The foregoing and other objects are achieved by a miniature incandescent lamp assembly which includes an elongated, sealed cylindrical envelope with leads extending outwardly from the ends of the envelope with open cylindrical metal end caps adapted to receive the ends of the envelope, and spaced therefrom with resilient, pliable material which adheres to the metal end caps, leads and lamp envelope, filling the end cap and extending between the lamp envelope and the adjacent end cap to resiliently support the lamp and the leads fixed to the end caps.

BRIEF DESCRIPTION OF THE DRAWINGS

The foregoing objects of the invention will be more clearly understood from the following description, taken in connection with the accompanying drawings, of which.

DESCRIPTION OF A PREFERRED EMBODIMENT

Figure 1:
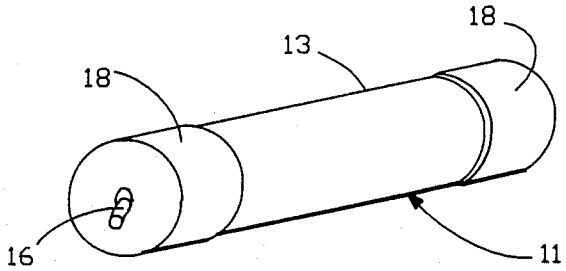
(PRIOR ART) FIG.-1
FIG. 1 is a perspective view of a prior art miniature incandescent lamp assembly.
Figure 2:
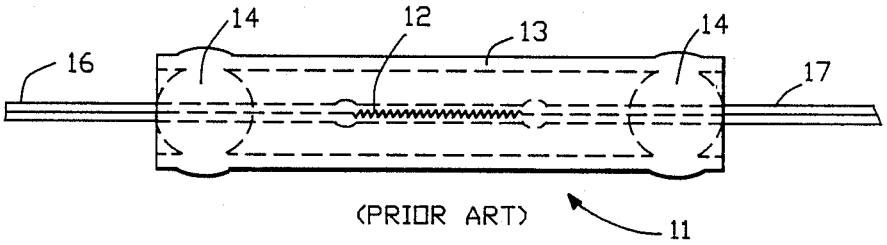
(PRIOR ART) FIG.-2
FIG. 2 is an elevational view of a miniature lamp of the prior art.
Figure 3:
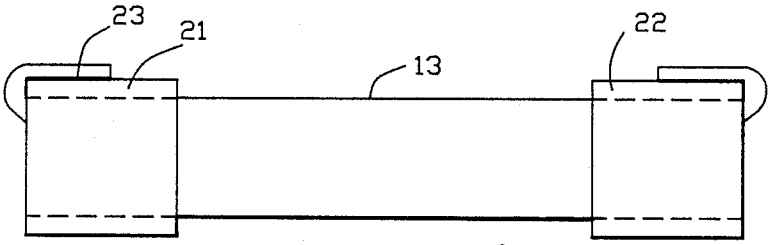
FIG. 3 is an elevational view of a surface mount miniature incandescent lamp assembly in accordance with this invention and FIG. 4 is a sectional view of one end of the lamp assembly of FIG. 3.
Figure 4:
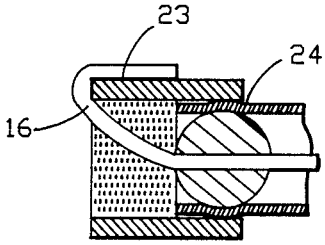

Referring now to FIGS. 3 and 4, the lamp 11 is shown mounted between open-ended end caps 21 and 22. The end caps have an internal diameter greater than the external diameter of the lamp envelope 13. The lead 16 extends outwardly past the end of the end cap and is bent over and suitably secured to the end cap as, for example, by a solder joint 23. The end of the end cap is filled with a resilient, pliable, high viscosity adhesive material which adheres to the metal end cap, the leads, and the glass envelope. The filling material is selected to have a viscosity which prevents from flowing out of the end cap and the space between the end cap and envelope prior to curing. Generally, the resilient material is a self-setting material which is a high viscosity fluid which can be injected into the end cap and forced to migrate into the space between the envelope 13 and end caps 21 and 22 to thereby provide resilient material 24 between the envelope and the end cap. The resilient material not only serves to bond and support the lamp in the end caps, but also serves to provide a resilient mount which absorbs any shock or vibration to protect the filament and adheres to and stabilizes the lead portion extending between the envelope and the end cap. To better appreciate the size of the lamp, a typical lamp envelope is 0.037 inches in diameter, with the end caps having an external diameter of 0.050 inches and internal diameter of 0.040, and the overall length of the assembly, end to end, being 0.25 inches.

Thus, there has been provided an improved, rugged surface mount miniature incandescent lamp assembly which can be placed on a circuit board for surface mount by a robotic means, and which can be secured to cooperating leads by soldering the end caps to the associated circuit board leads.

What is claimed is:

1. A surface mount miniature incandescent lamp assembly of the type which includes an incandescent lamp having an elongated sealed cylindrical envelope with an axially extending filament having leads extending outwardly from the ends of the envelope comprising:

open cylindrical metal end caps adapted to receive the ends of said sealed envelope and spaced therefrom, and providing connection to an associated circuit, and resilient, pliable material which adheres to the metal end cap, lamp leads and lamp envelope, filling the end of the cap and extending between the lamp envelope and the adjacent end cap to resiliently support the lamp and means for connecting the leads to the end cap.

2. An incandescent lamp assembly as in claim 1 in which said lamp leads are connected by soldering to the outside of said end caps.

3. An incandescent lamp assembly as in claim 1 in which the resilient, pliable material has a viscosity which permits filling of the end cap and space and cures to form the resilient support.

* * * * *